US005775586A

United States Patent [19]

Hamilton-Bruzzi et al.

[11] Patent Number: 5,775,586

[45] Date of Patent: Jul. 7, 1998

[54] FOUNTAIN HAVING INTERNALLY LIGHTED PLUME

[76] Inventors: Ginette Hamilton-Bruzzi; Richard Bruzzi, both of 6947 Coal Creek Pkwy. SE. #302, New Castle, Wash. 98059

[21] Appl. No.: 715,936

[22] Filed: Sep. 19, 1996

[51] Int. Cl.[6] ..... F21P 7/00

[52] U.S. Cl. ..... 239/20

[58] Field of Search ..... 239/18, 20

[56] References Cited

U.S. PATENT DOCUMENTS

| | | | |
|---|---|---|---|
| 490,378 | 1/1893 | Trouve | 239/18 |
| 492,999 | 3/1893 | Trouve | 239/18 |
| 1,243,126 | 10/1917 | Ziener | 239/20 |
| 1,762,126 | 6/1930 | Smith | 239/20 X |
| 1,839,994 | 1/1932 | Proffatt | 239/18 |
| 1,965,323 | 7/1934 | Taslitt | 239/20 |
| 2,034,792 | 3/1936 | Bergman | 239/18 |
| 2,973,904 | 3/1961 | Zimmermann et al. | 239/20 X |
| 2,974,872 | 3/1961 | Rodman | 239/20 |
| 3,088,675 | 5/1963 | Bone | 239/20 |
| 4,749,126 | 6/1988 | Kessener et al. | 239/18 X |

FOREIGN PATENT DOCUMENTS

| | | | |
|---|---|---|---|
| 4203107 | 8/1993 | Germany | 239/18 |

*Primary Examiner*—Lesley D. Morris
*Attorney, Agent, or Firm*—Robert W. Jenny

[57] ABSTRACT

The primary components of the fountain are a cover, a shallow container, a pump having a vertical translucent and at least one lamp. The pump is installed in the container, under the cover. The open end of the spout fits in a hole in the cover and the water flowing out of the spout forms a plume and then runs over the surface of the cover past openings in the cover into the container. The lamp(s) is/are installed inside the cover and illuminate the water in the plume through the translucent spout and also illuminate the water as it flows past the openings in the cover.

2 Claims, 1 Drawing Sheet

FOUNTAIN HAVING INTERNALLY LIGHTED PLUME

BACKGROUND OF THE INVENTION

1. Field

The subject invention is in the field of ornamental water fountains, particularly lighted fountains. More specifically, it is in the field of small ornamental fountains in which only the effluent water is illuminated. For purposes of this disclosure the vertical column of effluent water is termed the plume.

2. Prior Art

The inventor of the subject invention knows of no prior art fountains in which the effluent, particularly the plume, is internally illuminated. The closest known prior art fountains are those in which the plumes emanate from a pool of water which is illuminated by submerged lights. In other illuminated fountains the lighting is directed at the plume or plumes and in still others there is a combination of submerged lighting and light directed at the plumes.

The primary objective of the subject invention is to provide a fountain which is illuminated such that in darkness only the effluent of the fountain is visible. Other objectives are that the fountain be adaptable to many ornamental variations and be economically feasible, primarily because of its simplicity.

SUMMARY OF THE INVENTION

The subject invention is a fountain of which the basic characteristic is that in darkness only the effluent, particularly the plume or plumes, is/are visible. In a preferred embodiment the fountain is self contained, electrically powered and sized to be used on a shelf or table top. In this embodiment the enclosure comprises a cover and a shallow container and gravel on the bottom of the container. The cover is opaque and has the appearance, for example, of a river rock and is placed on the layer of gravel in the shallow container. The plume rises from the top of the cover and is about two inches high and ¾ of an inch in diameter. In the container there is an electrically powered pump which has a vertical spout. The upper and open end of the spout extends through an opening in the cover and the open end is approximately flush with the outer surface of the housing. The pump draws water from water in the container and produces the effluent. The pumped water (effluent) flows over the outer surface of the cover back into the container. The cover may have open portions spaced around its periphery.

The spout is made of translucent material and one or more lamps are mounted near it and shrouded so that illumination is directed primarily toward the spout. The illumination passes through the wall of the spout and illuminates the water of the plume and also illuminates the water cascading off of the edges of the cover.

The invention is described in more detail below with reference to the attached drawings.

DETAILED DESCRIPTION OF THE INVENTION

Figure 1:
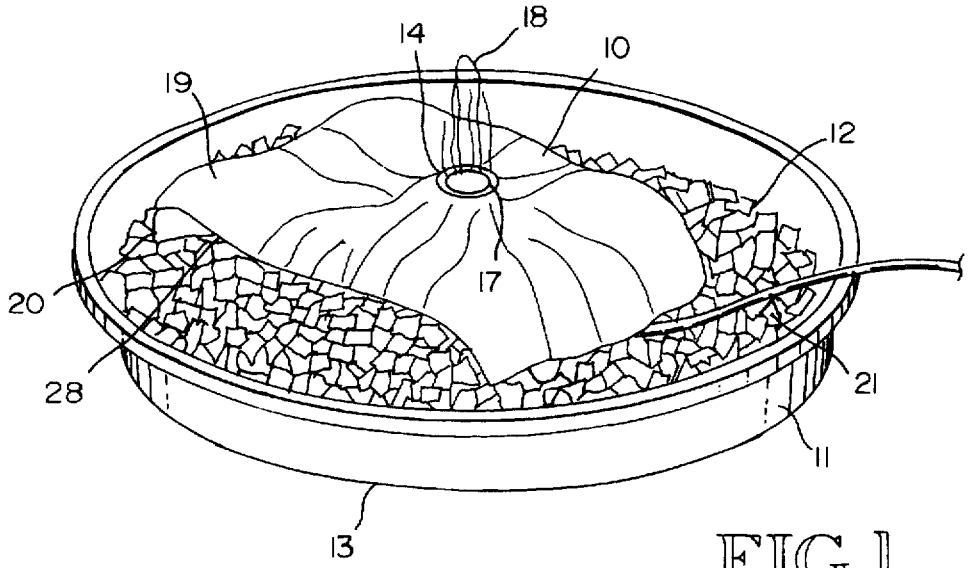
FIG. 1 is a general view of one embodiment of the subject invention in operation.

The subject invention is a fountain, the effluent from which includes a plume or plumes. The effluent is illuminated such that when the fountain is operating in darkness the effluent is visible. The embodiment of the invention shown in FIG. 1 comprises a cover 10 and an opaque shallow container 11. The cover rests on gravel 12 which is spread in a layer on bottom 13 of the container. Open end 14 of vertical spout 15 of pump 16 shown in FIG. 2 extends into hole 17 in the cover. The effluent from the pump forms a plume 18 and flows over the outer surface 19 of the cover and down across opening(s) in the cover, opening 20 being an example, into the water supply 21 in the container and obscured by the gravel. The pump is designed and/or adjusted to produce at least one plume which has a height and a major cross section dimension and the height is in a range one to six times the cross section dimension (diameter).

Figure 2:
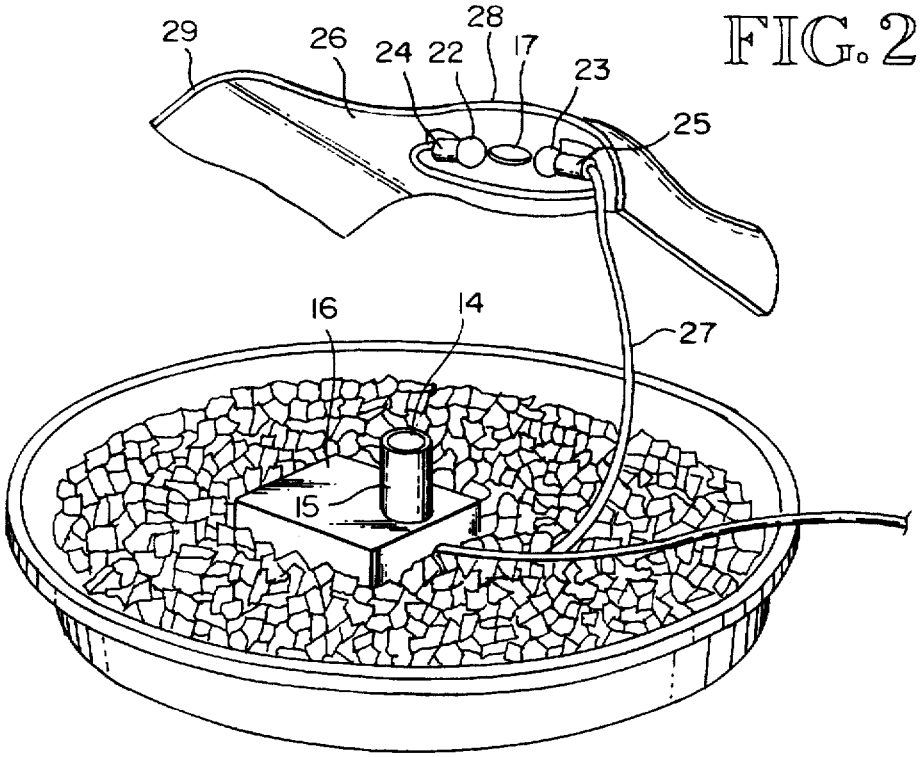
FIG. 2 illustrates the fountain of FIG. 1 with the cover lifted and tilted.

FIG. 2 illustrates the fountain of FIG. 1 with the cover lifted and tilted to show pump 16 and lamps 22 and 23. The lamps are installed in sockets 24 and 25 respectively which are attached to underside 26 of the cover. The sockets are attached to the cover with adhesive in this embodiment. In alternate embodiments the sockets are retained in clips attached to the cover, adhesively or mechanically.

The lamps and pump are electrically powered through wiring harness 27. Spout 15 is made of translucent material and the lamps are positioned so that the illumination they provide is concentrated primarily onto the spout The pump rests on the bottom of the container. The pump shown is an Aqua Pump 1 made by the Rolf C. Hagen Company in Mansfield, Mass. The lamp and sockets are available from the Radio Shack Co. and are 12 volt snap-in lamp assemblies.

When the fountain is operating in darkness the only illumination visible is that of the effluent in the plume and effluent flowing from the generally horizontal portions, portion 28 being typical, of edges, edge 29 being typical, of openings positioned and shaped such that the effluent flows past them, opening 20 being typical. In alternate embodiments there are no such openings and only the plume is visible in darkness. In alternate embodiments there may be more than one plume, provided by one pump through a manifold or by a pump for each plume or some combination of pumps and manifolding.

There can be many variations of the ornamental aspects of the subject fountain, including the color of the illumination. Such color is provided by coloration in the transparent material of the lamps or by transparent filters around the lamps or both. The fountain may be self contained or the water may be supplied from an external water system.

It is considered to be understandable from this description that the subject invention meets its objectives. It provides a fountain which is illuminated such that in darkness only the effluent of the fountain is visible. It is adaptable to many ornamental variations and is economically feasible because its components are easily manufactured and/or commercially available and are easily assembled.

It is also considered to be understood that while certain embodiments of the invention are described herein, other embodiments and modifications of those described are possible within the scope of the invention which is limited only by the attached claims.

I claim:

1. A fountain comprising:

a container, an opaque cover having at least one hole and an outside surface, and means for producing effluent including at least one plume, said at least one plume having a height and a major cross sectional dimension, said height being in a range of one to six times said major cross sectional dimension, said cover being placed in said container, said means for producing said effluent being installed in said container under said cover and comprising at least one spout, said spout having an open end and being made of translucent material, said open end extending into said at least one hole, said fountain further comprising means under said cover for illuminating said at least one spout whereby said effluent is illuminated.

2. The fountain of claim one in which there is at least one opening in said cover positioned and shaped such that said effluent flows past said at least one opening and is illuminated by said means for illuminating.

* * * * *